US010680341B1

(12) United States Patent
Anderson et al.

(10) Patent No.: US 10,680,341 B1
(45) Date of Patent: Jun. 9, 2020

(54) MULTIFUNCTION ADDITIVE ANTENNA ARRAY

(71) Applicant: L3 Technologies, Inc., New York, NY (US)

(72) Inventors: Trevis D. Anderson, New York, NY (US); Jared E. Campbell, New York, NY (US); Michael C. Hollenbeck, New York, NY (US); Robert H. Smith, New York, NY (US)

(73) Assignee: L3 Technologies, Inc., New York, NY (US)

( * ) Notice: Subject to any disclaimer, the term of this patent is extended or adjusted under 35 U.S.C. 154(b) by 51 days.

(21) Appl. No.: 15/867,048

(22) Filed: Jan. 10, 2018

(51) Int. Cl.
*H01Q 15/14* (2006.01)
*H01Q 19/13* (2006.01)
*H01Q 15/16* (2006.01)

(52) U.S. Cl.
CPC ..... *H01Q 15/16* (2013.01); *H01Q 15/14* (2013.01); *H01Q 15/142* (2013.01); *H01Q 19/13* (2013.01); *H01Q 19/132* (2013.01)

(58) Field of Classification Search
CPC .... H01Q 15/161; H01Q 1/288; H01Q 15/168; H01Q 9/14; H01Q 1/103; H01Q 9/145; H01Q 15/16; H01Q 15/142; H01Q 19/132; H01Q 15/14; H01Q 19/13
USPC ..... 343/915, 723, 868, 880, 901
See application file for complete search history.

(56) References Cited

U.S. PATENT DOCUMENTS 5,223,850 A * 6/1993 Branigan ..... H01Q 25/02 343/771
5,307,077 A * 4/1994 Branigan ..... G01S 13/4463 342/53
8,736,505 B2 5/2014 Lambert et al.
9,112,255 B1 * 8/2015 Hollenbeck ..... H01P 5/182
2015/0244074 A1 * 8/2015 Pera ..... H01Q 1/42 343/833

OTHER PUBLICATIONS

Huang et al. "Design of a Wideband and Low-Profile Monopulse Array Fabricated by 3-D Metal Printing Technique" IEEE AP-S, 2015, pp. 322-323.

(Continued)

*Primary Examiner* — Hai V Tran
(74) *Attorney, Agent, or Firm* — Workman Nydegger

(57) ABSTRACT

Optimizations are provided in the design and fabrication of a parabolic antenna reflector. In particular, a parabolic antenna reflector comprises an inner reflective face being formed in a parabolic shape and a first outer circumferential portion. The parabolic antenna also includes an outer face being formed in a different parabolic shape and a second circumferential portion. The first outer circumferential portion is coupled to the second outer circumferential portion to form an inner body between the inner reflective face and the outer face. This inner body includes a monopulse comparator waveguide. As a result, the monopulse comparator waveguide is embedded between the inner reflective face and the outer face. In some instances, this waveguide includes one or more bends. Additionally, in some instances, the parabolic antenna reflector is fabricated using additive manufacturing techniques such that the parabolic antenna reflector is a single printed unit.

20 Claims, 12 Drawing Sheets

(56) References Cited

OTHER PUBLICATIONS

Huang et al. "Fabrication of a High-Efficiency Waveguide Antenna Array via Direct Metal Laser Sintering", IEEE Antennas and Wireless Propagation Letters, 2015, pp. 1-4.
Shelley et al. "X- and Ka-Band low profile antennas for aeronautical and land mobile satcom" The 8th European Conference on Antennas and Propagation (EuCAP 2014), 2014, pp. 2619-2622.

* cited by examiner

MULTIFUNCTION ADDITIVE ANTENNA ARRAY

BACKGROUND

Reflector antennas are useful for a wide variety of applications. For example, reflector antennas are used in microwave relay linking, point to point communications, VSAT (very small aperture terminal) applications, and many other types of applications. In some instances, reflector antennas are used to track objects in the earth's orbitals (e.g., satellites) while in other instances dish antennas are used to track earth-side objects (e.g., vehicles or even missile trajectories).

In addition to the above applications, reflector antennas can be augmented to include monopulse tracking functionality. At a high level, monopulse tracking is a high precision target tracking technique. To achieve this high precision tracking, monopulse systems capture an incoming radiation signal and then measure that signal's arrival direction. To capture that signal, a monopulse system uses different quadrants of a feed horn array. The signal is then analyzed by a monopulse comparator network. In particular, the monopulse comparator network processes the return signals to generate a sum signal, two delta signals (Azimuth, Elevation), and a Q channel. These signals are then used to determine the direction of peak signal strength for the target. Accordingly, by using the antenna's feed horn array and the monopulse comparator network, a monopulse tracking system is able to precisely monitor and track a target's location and movement.

The monopulse comparator network discussed above is formed using several radio frequency (RF) building blocks. Some of these RF components include straight and rotational waveguides, hardware filtering components, hardware amplifier components, power splitters, and phase shifters. Notably, these RF building blocks are used to receive and manipulate the incoming radio waves to use for tracking the target. This same network also serves as the transmit path of the antenna via the sum port.

Receiving, transmitting, and manipulating radio waves are core functions of an antenna system (and a monopulse tracking system). Worthwhile to note, when unconfined, a radio wave will propagate in all three spatial dimensions. In other words, radio waves propagate as a spherical wave through space. Waveguides, which were briefly introduced above, have been developed to confine a radio wave's propagation. In particular, a waveguide is a metallic transmission line that restricts a radio wave so that it travels in only one direction. Waveguides are beneficial because even though they restrict a wave's propagation, the waveguide is structured so that the wave will not lose significant power. In order to redirect a radio wave, a waveguide must include walls that are completely reflective. Because of these reflective properties, the radio waves are routed through the waveguide in the desired direction.

Antennas, including monopulse tracking systems, use waveguides. In particular, an antenna uses a waveguide to transfer radio frequency energy between various portions of the antenna system. For instance, a waveguide may be used to connect an antenna to its transmitter or to its receiver. Furthermore, the monopulse comparator network, which was briefly discussed above, also uses waveguides when calculating the sum and delta signals.

While it is known how to design antennas that perform monopulse tracking, current designs are limited because they produce dish antennas that are bulky and difficult to work with. By way of example, current dish antenna designs physically mount the RF components on a rear portion of the dish antenna. As a result, there is not a lot of physical space behind the antenna to mount other hardware components. Furthermore, when hardware is mounted on the rear portion of the dish antenna, the antenna's center of gravity changes. As a result, it is necessary to reinforce and potentially even customize each antenna's mounting framework and direction control mechanisms. Accordingly, there is a substantial need to improve how a dish antenna is designed. Even more particularly, there is a substantial need to improve the design of antennas used for monopulse tracking.

The subject matter claimed herein is not limited to embodiments that solve any disadvantages or that operate only in environments such as those discussed above. Rather, this background is provided to illustrate only one exemplary technology area where some of the embodiments described herein may be practiced.

BRIEF SUMMARY

Disclosed embodiments are directed to improvements in the design and fabrication of a parabolic antenna reflector.

In some embodiments, a parabolic antenna reflector is comprised of an inner reflective face and a structure used to support the reflective front face. Construction of the inner reflective face results in a similarly shaped rear surface (i.e. an outer face), which is offset in nature from the inner reflective face. The inner reflective face is formed in a parabolic shape and includes a first outer circumferential portion. Similarly, the outer face is also formed in a parabolic shape, but its shape is different than the inner reflective face's shape. Also, the outer face includes a second outer circumferential portion. The first outer circumferential portion is coupled to the second outer circumferential portion to form an inner body between the inner reflective face and the outer face. Here, the inner body comprises a monopulse comparator waveguide structure embedded and in the volume between the inner reflective face and the rear surface (i.e. the outer face). Furthermore, this monopulse structure is fabricated as a single continuous body during build of the reflector. As a result, this waveguide is embedded between the inner reflective face and the outer face.

Other embodiments are directed to a parabolic reflector antenna. This antenna includes a feed horn array, one or more mounting struts, a sub-reflector, and a parabolic-shaped main reflector. This parabolic-shaped main reflector is comprised of an inner face that is formed in a parabolic shape and an outer face that is formed in a different parabolic shape. The parabolic-shaped main reflector also includes two monopulse comparator waveguides (resulting in four paths from the horn). Both waveguides are embedded in an inner body that is formed by a union of an outer circumference of the inner face and an outer circumference of the outer face. Notably, the second monopulse comparator waveguide is disposed in the inner body at a position that is opposite to a position of the first monopulse comparator waveguide.

Other embodiments are directed to an antenna system. This antenna system includes one or more hardware processors and one or more computer-readable hardware storage devices. Computer-executable instructions are stored on these hardware devices and, when executed, cause the processors to perform monopulse tracking. Further, the antenna system includes a feedhorn array, one or more mounting struts, a sub-reflector, and a parabolic-shaped main reflector. This parabolic-shaped main reflector is comprised of an inner face that has a parabolic shape and an outer face that has a different parabolic shape. The parabolic-shaped main reflector also includes two monopulse comparator waveguides (resulting in four paths from the horn). These waveguides are both embedded within an inner body formed by a union of an outer circumference of the inner face and an outer circumference of the outer face.

This Summary is provided to introduce a selection of concepts in a simplified form, which concepts are further described below in the Detailed Description. This Summary is not intended to identify key features or essential features of the claimed subject matter, nor is it intended to be used as an aid in determining the scope of the claimed subject matter.

Additional features and advantages will be set forth in the description which follows and, in part, will be obvious from the description, or may be learned by the practice of the teachings herein. Features and advantages of the embodiments may be realized and obtained by means of the instruments and combinations particularly pointed out in the appended claims. Features of the embodiments will become more fully apparent from the following description and appended claims, or may be learned by the practice of the embodiments as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Figure 1:
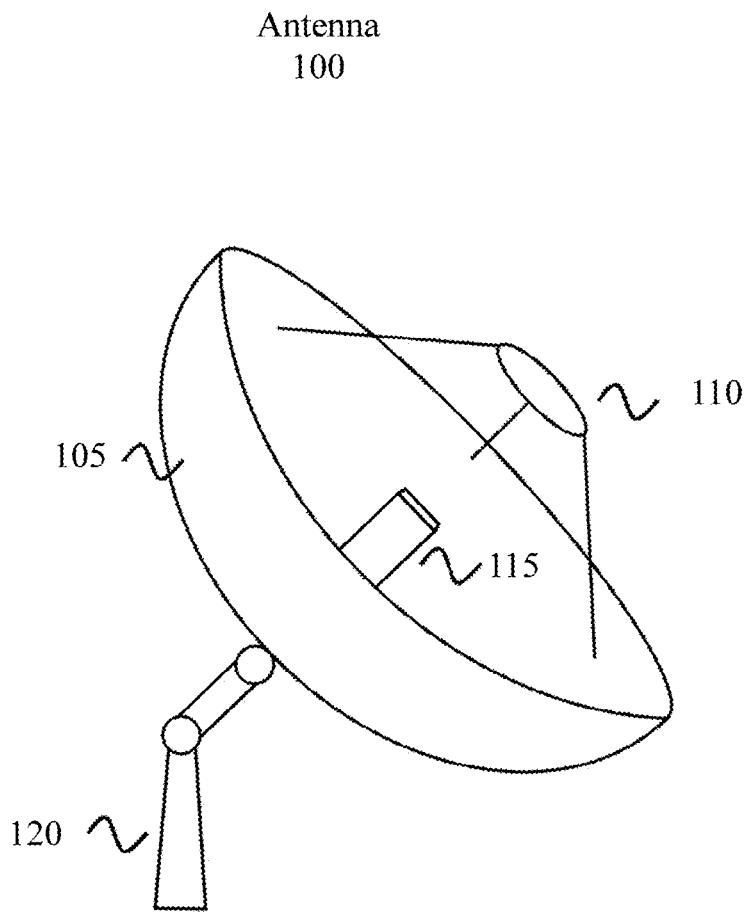
FIG. 1 illustrates an exemplary parabolic dish antenna.

Disclosed embodiments are directed to improvements in the design and fabrication of a parabolic antenna reflector.

The embodiments may be implemented to overcome many of the technical difficulties involved in the design and fabrication of a parabolic antenna reflector. In particular, the current embodiments cause one or more radio frequency (RF) components to be embedded inside the main reflector itself as opposed to those components being physically mounted to a back portion of the main reflector. In some instances, causing the RF components to be embedded inside the main reflector is achieved through the use of additive manufacturing techniques. As a result, a single 3-dimensional unit may be created, which single unit includes the main reflector's inner and outer face as well as the embedded RF components. In some instances, other portions of the antenna structure are also fabricated using additive manufacturing techniques and are either embedded inside the main reflector or additively built on it. As a result, the single 3-dimensional unit may include many other physical structures as well (e.g., the sub-reflector, the feed horn array, various mounting struts, various hardware amplifiers, various hardware filters, etc.).

The present embodiments directly improve the current technology because they reduce both fabrication time, fabrication costs, and assembly time. Further, the present embodiments eliminate the need to interact with multiple vendors to acquire the needed hardware components. To clarify, the traditional technology requires monopulse tracking system developers to contract with many different vendors to acquire all of the necessary parts. For example, developers previously had to individually contact waveguide manufacturers, dish manufacturers, etc. Using the principles discussed herein, however, developers no longer need to contact different vendors to create a monopulse tracking system because the system can be fabricated using additive manufacturing techniques. As a result, the embodiments significantly reduce the amount of time required to fabricate such a system.

The present embodiments also improve the current technology because they leverage novel three-dimensional fabrication techniques to combine multiple, complex parts into a single printed unit. This process provides many benefits, including but not limited to, the ability to fabricate significantly more complex hardware geometries in a compact space without the need for flanges or other interface points, the ability to significantly reduce assembly time, and the ability to reduce the total number of seams in RF waveguide pieces. Notably, because the number of seams and connections are reduced for the various RF components, the antenna's overall performance is significantly improved.

The present embodiments also improve the current technology by eliminating the need to perform manual tuning. For instance, conventional monopulse tracking systems require extensive manual tuning to ensure that the waveguides do not introduce undesired reflections. By following the principles discussed herein, however, the need to perform manual tuning is eliminated because the waveguides are fabricated as a single unit to meet certain pre-established tolerances. Further, by embedding the waveguides in the main reflector itself, the waveguides are positioned physically closer to the feed horn array than conventional antenna structures. Because of this placement, the embodiments operate to eliminate undesired waveguide losses. To clarify, the closer placement helps reduce waveguide losses.

The embodiments also improve the current technology by freeing up the amount of physical space on the rear portion of the main reflector. As discussed earlier, convention reflectors are required to have all of their hardware components physically mounted to their backside. This positioning not only introduces the possibility of impedance mismatching and undesired waveguide losses but it also significantly changes the antenna's center of gravity. As a result, the traditional technology requires reinforcements to an antenna's mounting struts and positional control mechanisms. The current embodiments provide significant advancements to the art by moving many of the RF components to an internal portion of the reflector itself. As a result, the embodiments improve many of the structural aspects of an antenna.

To achieve these benefits, some of the disclosed embodiments are directed to a parabolic antenna reflector that is comprised of an inner reflective face and an outer face. The inner reflective face is formed in a parabolic shape and includes a first outer circumferential portion. Similarly, the outer face is also formed in a parabolic shape, but its shape is different than the inner reflective face's shape. Also, the outer face includes a second outer circumferential portion. The first outer circumferential portion is coupled to the second outer circumferential portion to form an inner body between the inner reflective face and the outer face. Here, the inner body comprises a monopulse comparator waveguide. As a result, this waveguide is embedded between the inner reflective face and the outer face.

Other embodiments that achieve the above-mentioned benefits are directed to a parabolic reflector antenna. This antenna includes a feed horn array, one or more mounting struts, a sub-reflector, and a parabolic-shaped main reflector. This parabolic-shaped main reflector is comprised of an inner face that is formed in a parabolic shape and an outer face that is formed in a different parabolic shape. The parabolic-shaped main reflector also includes two monopulse comparator waveguides. Both waveguides are embedded in an inner body that is formed by a union of an outer circumference of the inner face and an outer circumference of the outer face. In these embodiments, the second monopulse comparator waveguide is disposed in the inner body at a position that is opposite to a position of the first monopulse comparator waveguide.

Still further, other embodiments that achieve the above-mentioned benefits are directed to an antenna system. This antenna system includes one or more hardware processors and one or more computer-readable hardware storage devices. Computer-executable instructions are stored on these hardware devices and, when executed, cause the processors to perform monopulse tracking. Further, the antenna system includes a feedhorn array, one or more mounting struts, a sub-reflector, and a parabolic-shaped main reflector. This parabolic-shaped main reflector is comprised of an inner face that has a parabolic shape and an outer face that has a different parabolic shape. The parabolic-shaped main reflector also includes two monopulse comparator waveguides. These waveguides are both embedded within an inner body formed by a union of an outer circumference of the inner face and an outer circumference of the outer face.

Figure 12:
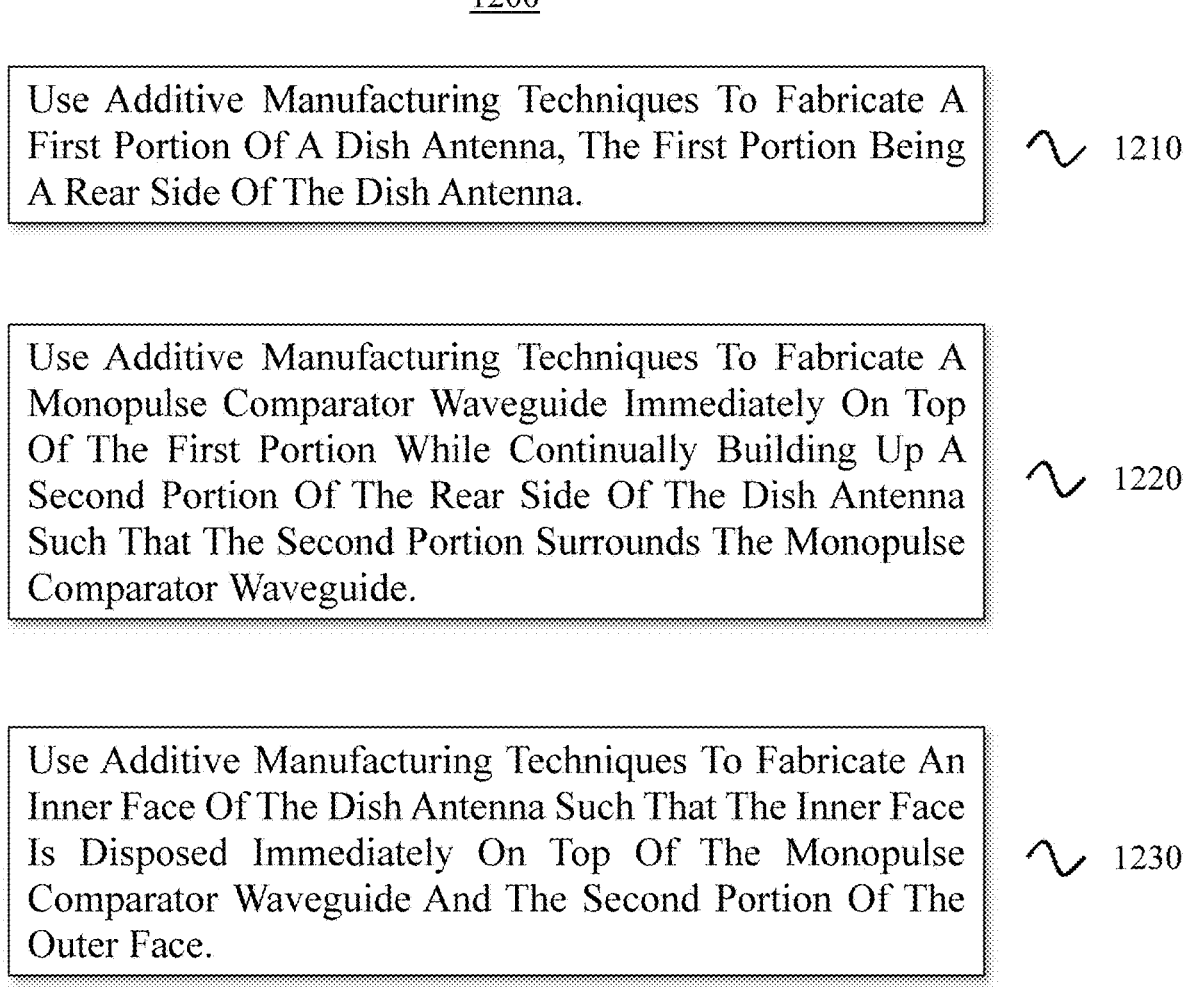
FIG. 12 illustrates an exemplary method for fabricating the parabolic dish antenna.

Having just described various benefits and high-level attributes of the embodiments, the disclosure will now focus on FIG. 1, which presents a high-level view of a parabolic reflector antenna. Following that discussion, various architectures and supporting illustrations will be discussed using FIGS. 2-10. Lastly, a flow diagram is illustrated in the final figure (FIG. 12).

Antenna Array

As illustrated in FIG. 1, an exemplary dish antenna 100 includes, in its most basic configuration, a parabolic main reflector 105, a sub-reflector 110, a feed horn array 115, and an antenna positioner 120.

The parabolic main reflector 105 has a cross-sectional shape of a parabola. Because of this parabolic shape, the parabolic main reflector 105 is able to direct radio waves in a particular direction. The parabolic main reflector 105 directs radio waves in a particular direction creating a narrow beam of energy.

In addition to receiving radio frequency energy, the parabolic main reflector 105 can also be used to transmit energy. For instance, the parabolic main reflector 105 can be used to transmit a beam of energy to locate and/or track remote objects. As discussed earlier in connection with monopulse tracking, the parabolic main reflector 105 can be used to track a signal being received.

To transmit such a signal, the feed horn array 115 initially emits radio energy. This energy is first reflected off of the sub-reflector 110. After bouncing off of the sub-reflector 110, the radio energy is directed back to the parabolic main reflector 105. After striking the parabolic main reflector 105, the radio energy is again redirected. This time, the radio energy is directed away from the antenna and is directed towards a target object.

The antenna positioner 120 is used to aim the entire unit. The antenna positioner 120 is configured to allow the antenna 100 to be aimed essentially in any direction. As a result, the antenna 100 can be used to both receive and propagate radio energy. Furthermore, the antenna 100 can be used to track remote objects.

Figure 2:
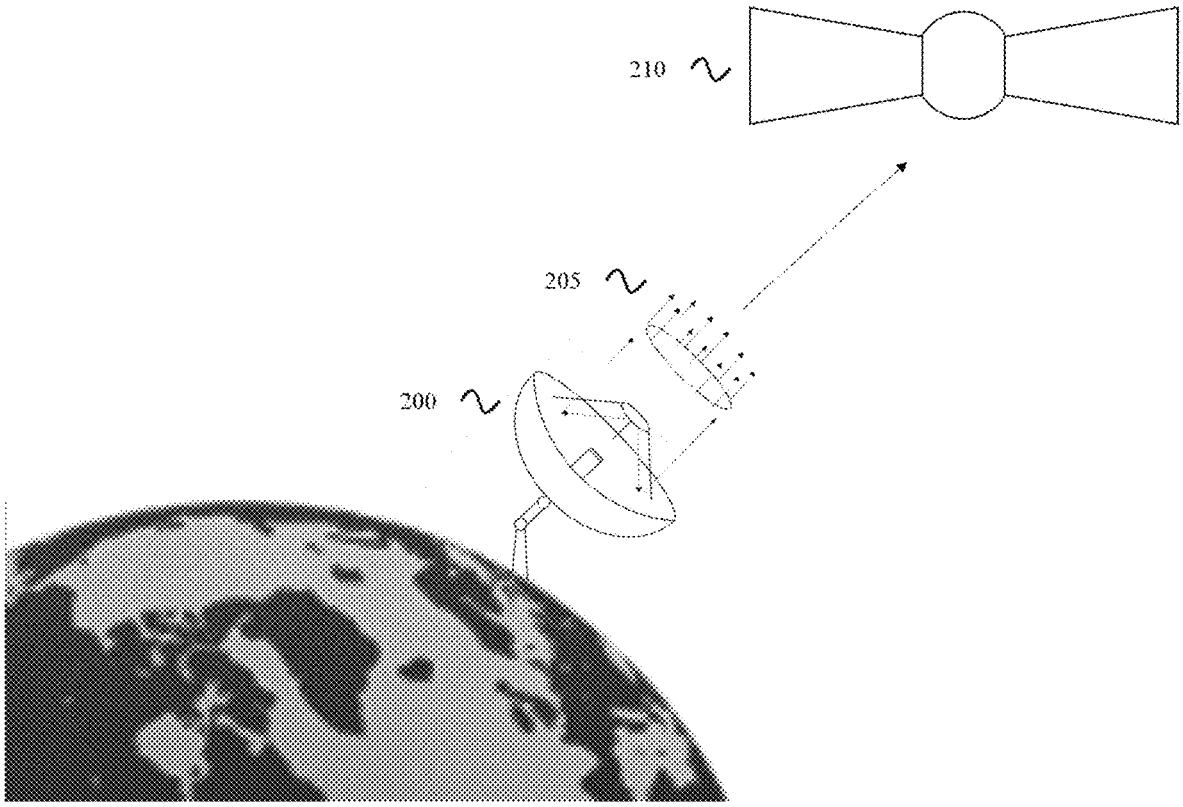
FIG. 2 illustrates a parabolic dish antenna tracking a foreign object.

FIG. 2 illustrates an example scenario in which an antenna is tracking a remote object. In particular, FIG. 2 illustrates an earth-side antenna 200 that is propagating radio energy 205 towards a satellite 210 located in the earth's orbitals. Antenna 200 is able to use monopulse tracking techniques to determine the angular position of the satellite 210 and to continuously monitor satellite 210's position.

In order to perform monopulse tracking, an antenna is required to have various hardware components. Accordingly, attention will now be directed to FIG. 3 which shows an exemplary antenna system 300.

As shown, the antenna system 300 includes one or more hardware processors 305, input/output (I/O) devices 310, RF components 315, hardware amplifier components 320, hardware filters 325, reflectors 330, and data storage 335. The ellipses 340 demonstrates that the antenna system 300 is not limited to just the features and components illustrated in FIG. 3. Instead, the antenna system 300 may be configured to include additional structures and components. Accordingly, the antenna system 300 should not be limited solely to the subject matter presented in FIG. 3.

Embodiments of the present invention may be used to perform monopulse tracking. To perform this type of tracking, the embodiments may execute computer-executable instructions which are stored in the data storage 335. Because monopulse tracking is generally known in the art, it is not necessary to further discuss the processes involved. It is worthwhile to note, however, that the embodiments discussed herein are able to utilize a general-purpose computer, special-purpose computer, or special-purpose processing device to perform the various processes involved in monopulse tracking.

Figure 4:
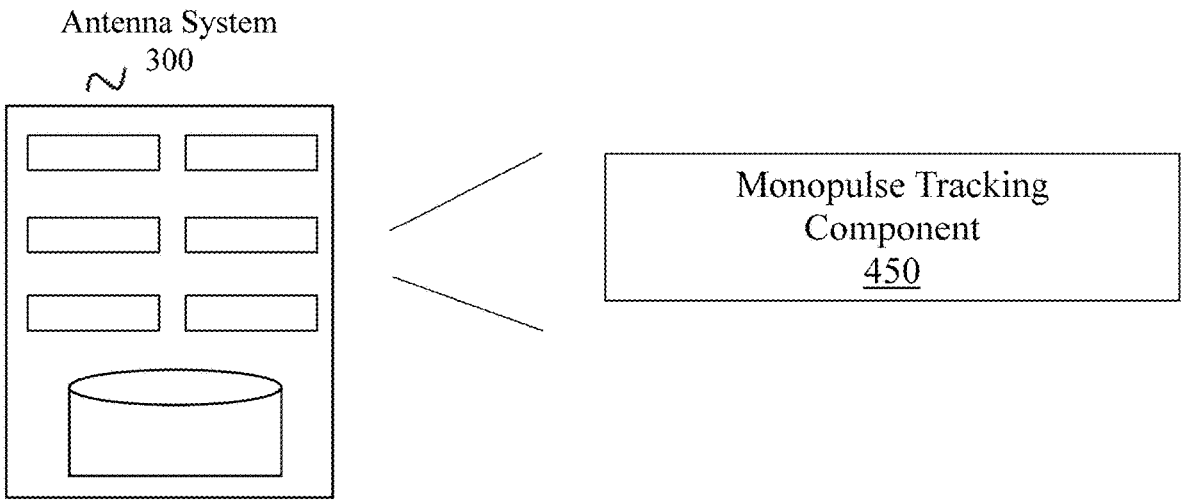
FIG. 4 illustrates an exemplary antenna system configured to perform monopulse tracking.

Turning now to FIG. 4, FIG. 4 shows that the antenna system 300 may include a monopulse tracking component 450. Accordingly, the present embodiments are able to perform monopulse tracking though the use of the monopulse tracking component 450.

Figure 3:
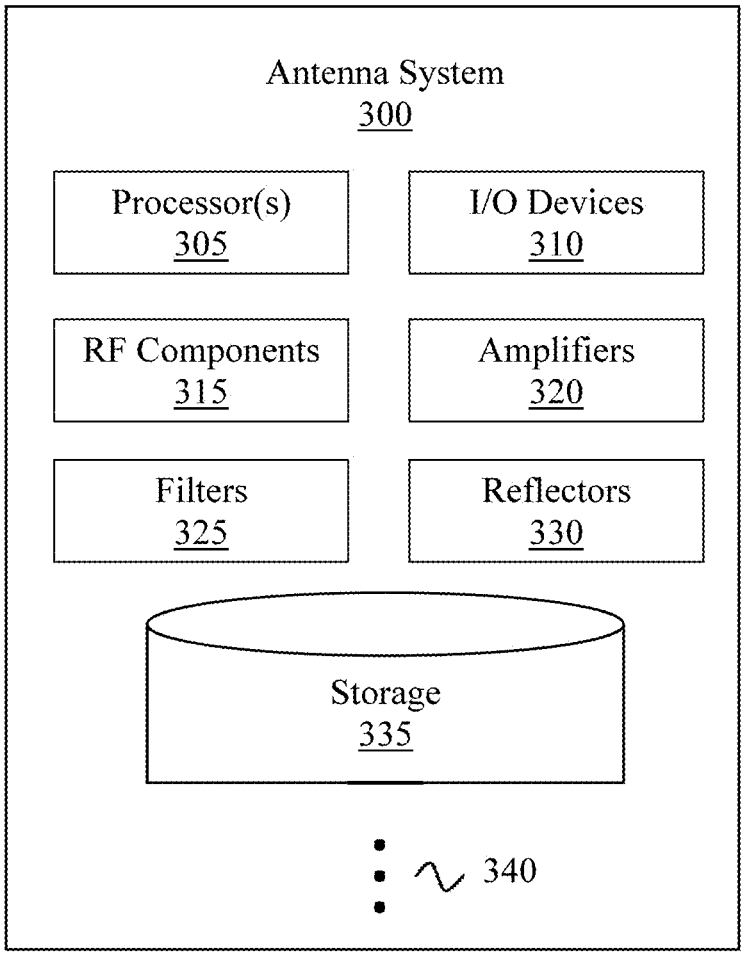
FIG. 3 illustrates an exemplary antenna system.
Figure 5:
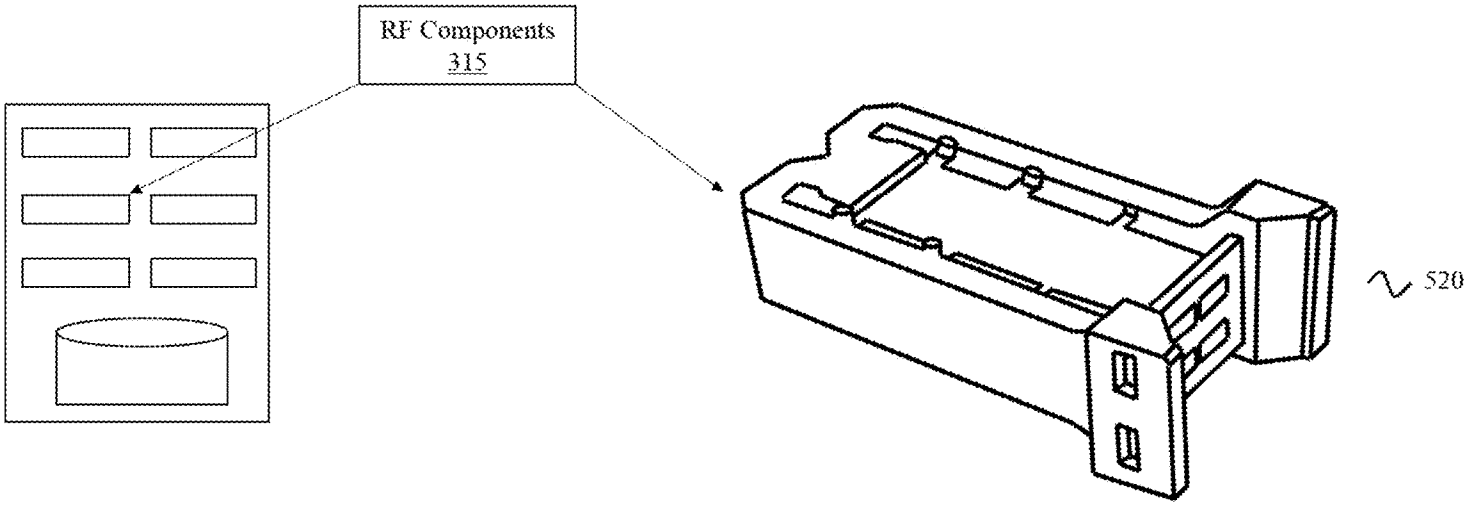
FIG. 5 illustrates a type of radio frequency component that is used in an antenna system.

Turning now to FIG. 5, FIG. 5 shows that the RF components 315, which were introduced in FIG. 3, include, but are not limited to a waveguide 520. Such a waveguide 520 may be made of brass, copper, silver, aluminum, or any other material that constrains the propagation of an electromagnetic wave. Similar to the subject matter introduced earlier, this waveguide 520 is configured to confine a radio wave so that the wave propagates in only a single dimension. Further, this waveguide 520 is structured so that very little energy is lost when the radio wave is redirected.

Figure 6:
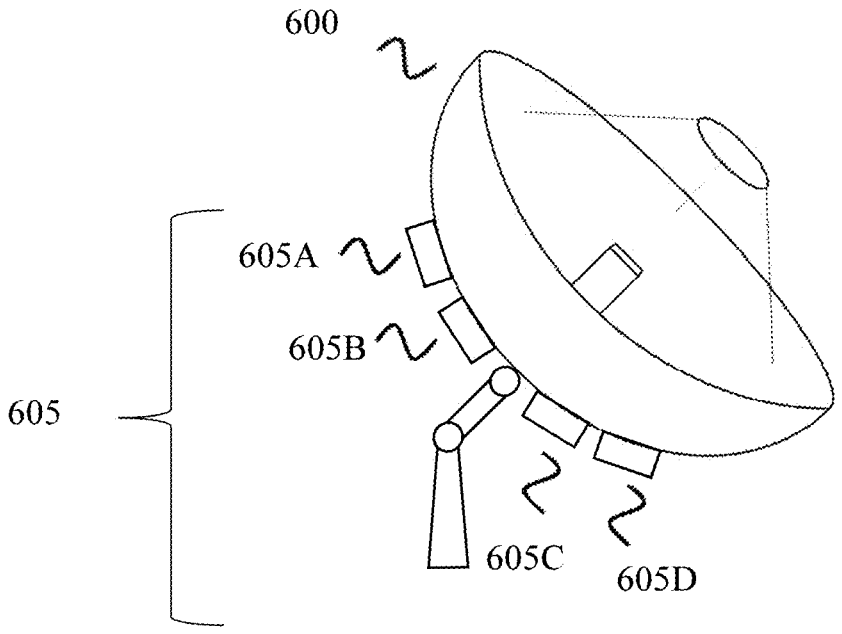
FIG. 6 illustrates a parabolic dish antenna that has various different hardware components physically mounted to a back side of the antenna.

FIG. 6 illustrates a conventional antenna 600. This conventional antenna 600 is illustrated as having a plurality of hardware components 605 mounted on a rear portion of the antenna 600. The plurality of hardware components 605 includes component 605A, 605B, 605C, and 605D. This plurality of hardware components 605 may include the waveguide 520 discussed in connection with FIG. 5. Further, the plurality of hardware components 605 may include hardware amplifier components, hardware filtering components, diplexers, or any other type of RF component or antenna hardware component.

Because the plurality of hardware components 605 are physically mounted to the back of the conventional antenna 600, it was necessary to ensure the mounting was structurally sound, ensure the impedances were properly matched between the RF components, and ensure that the supporting struts could properly control the conventional antenna 600. The current embodiments, however, significantly improve an antenna's design because some of the hardware components are embedded into the main parabolic reflector.

Figure 7:
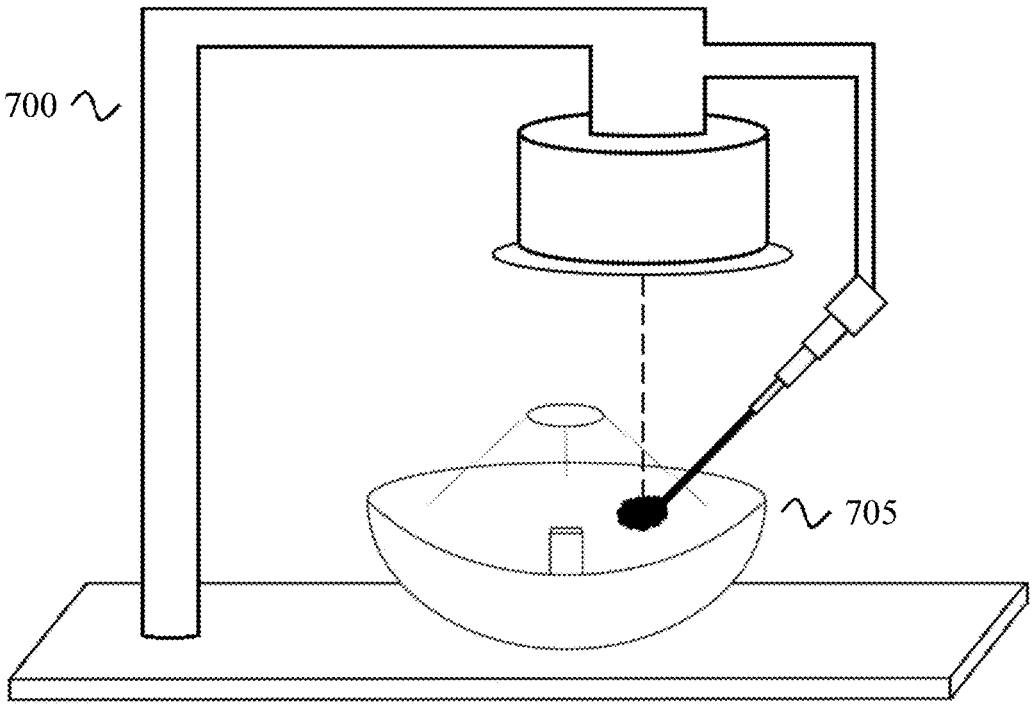
FIG. 7 illustrates an additive manufacturing system capable of printing a single-body parabolic dish antenna.

Accordingly, attention will now be directed to FIG. 7, which illustrates an additive manufacturing system 700. As shown in FIG. 7, the additive manufacturing system 700 is currently constructing/fabricating a parabolic dish antenna 705.

The present embodiments leverage additive manufacturing technologies to fabricate a single-piece reflector antenna. By using these additive manufacturing techniques, the single-piece reflector antenna can be constructed in a manner such that the single-piece body includes a parabolic main reflector (e.g., the parabolic main reflector 105 shown in FIG. 1), a feed horn array (e.g., the feed horn array 115 of FIG. 1), mounting features (e.g., the antenna positioner 120 shown in FIG. 1), and various RF components (e.g., a monopulse comparator) that are embedded within the parabolic main reflector. By using additive manufacturing techniques, the embodiments combine multiple complex parts into a single 3-dimensional printed part. This process significantly reduces the cost and assembly time for creating a monopulse tracking system. Furthermore, due to advanced three-dimensional fabrication techniques, a dual-axis monopulse comparator is now able to be wrapped (i.e. bent) conformally to the parabolic shape of the parabolic main reflector. As a result, the features and designs of the monopulse comparator's waveguides are strategically hidden from view (because the waveguides are completely embedded within the reflector). Furthermore, an embedded monopulse comparator is much more protected than a comparator that is placed on an outer portion of the reflector. Indeed, the reflector itself is now adding an additional protective layer for the monopulse comparator.

Further, by using additive manufacturing techniques, the resulting single-unit reflector, which includes the embedded RF components, significantly reduces the total number of transition points (i.e. seams) in the various RF waveguide pieces. As a result, the overall performance of the antenna is significantly improved. Even further, by using precise additive manufacturing processes, the need to perform manual tuning is eliminated.

Accordingly, the embodiments provide for a single body reflector that includes an embedded monopulse comparator. These embodiments may be practiced in a variety of situations and settings. By way of example and not limitation, one application for this novel technology is in the development of tracking solutions using antennas configured to operate in the Ka-band (and above). Due to the narrow beam widths of antennas at the Ka-band and above, tracking is essential for maintaining a link with the target object. However, due to the small wavelengths at higher frequencies (which small wavelengths cause the form factor of the dish antenna to be smaller, e.g., 9.5 inches), the conventional antenna systems are deficient because they fail to provide adequate physical space on the rear portion of the antenna. As a result, the hardware components needed to perform the tracking functions (traditionally) were not placed as close to the received signal as possible. These characteristics led the antennas to not be very efficient. Now, however, the embodiments actually cause the RF components to be embedded within the parabolic main reflector. Furthermore, by introducing other optimizations (e.g., introducing a bend to the monopulse comparator, which will be discussed in more detail later), the embodiments ensure that the hardware components are as close to the incoming signal as possible. Accordingly, the present embodiments significantly improve the current technology.

Figure 8:
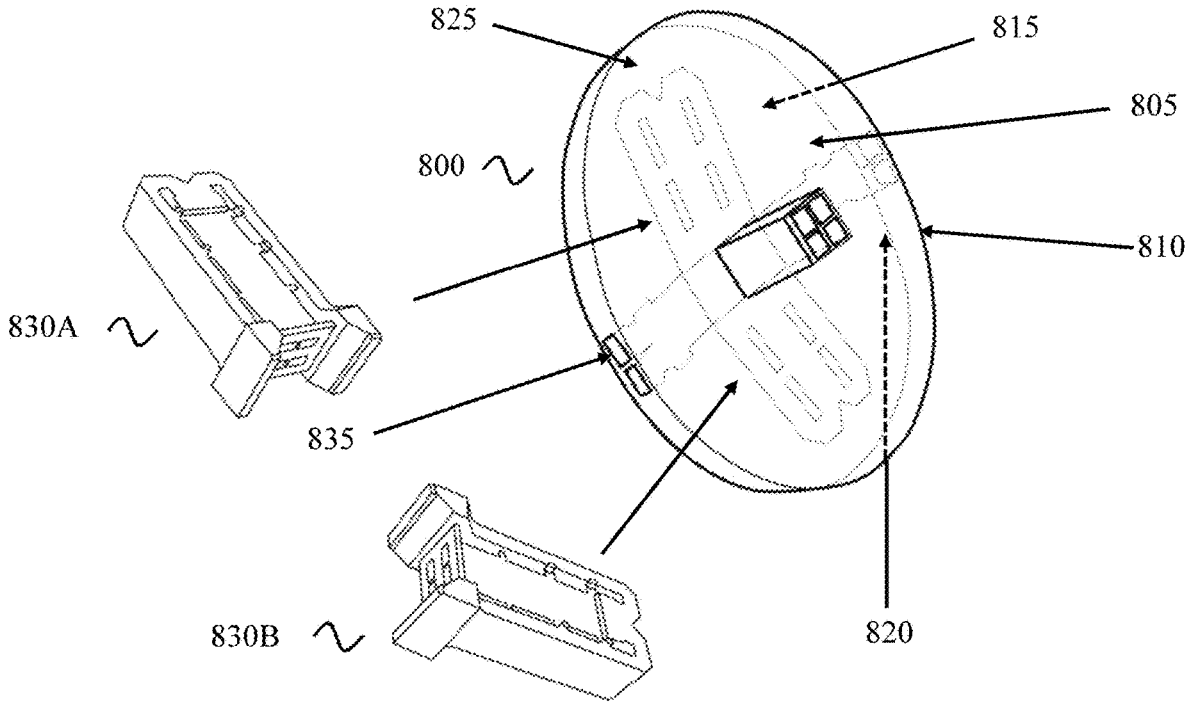
FIG. 8 illustrates an exemplary parabolic dish antenna that has various radio frequency hardware components embedded inside of the antenna.

Attention will now be turned to FIG. 8 which more fully illustrates the optimizations and improvements that are created by the current embodiments.

Embedded RF Components

In particular, FIG. 8 shows a parabolic main reflector 800. This parabolic main reflector 800 includes an inner face 805 (which inner face 805 has an outer circumference 810). The parabolic main reflector 800 also has an outer face 815 (which outer face 815 also has an outer circumference 820). The inner face 805 is positioned on a side of the parabolic main reflector 800 near where a sub-reflector (not shown) would be placed while the outer face 815 is positioned on a rear side (i.e. a side opposite to where the sub-reflector would be placed). Both the inner face 805 and the outer face 815 are formed to have parabolic shapes, but the parabolic shape of the inner face 805 is different than the parabolic shape of the outer face 815. Worthwhile to note, the inner face 805 is reflective so that it efficiently directs radio wave energy in a particular direction.

As shown in FIG. 8, the outer circumference 810 of the inner face 805 is coupled to the outer circumference 820 of the outer face 815. Because of this coupling, an inner body 825 is formed between the inner face 805 and the outer face 815.

FIG. 8 also shows that a monopulse comparator (formed by two waveguide structures 830A and 830B resulting in four paths from the horn) is embedded inside the parabolic main reflector 800 (i.e. in the inner body 825). To clarify, the inner body 825 comprises one or more monopulse comparator waveguides. As a result, the one or more monopulse comparator waveguides are embedded between the inner face 805 and the outer face 815.

By using an additive manufacturing system (e.g., the additive manufacturing system 700 of FIG. 7), the parabolic main reflector 800 can be progressively built in such a manner that the waveguides 830A and 830B are fabricated inside the parabolic main reflector 800.

FIG. 8 also shows that the parabolic main reflector 800 may include one or more feed ports 835. To clarify, using the additive manufacturing techniques, the parabolic main reflector 800 may be fabricated in such a manner so as to include one or more feed ports 835. In some instances, these feed ports 835 may be included on the outer face 815 of the parabolic main reflector 800 while in other instances, the feed ports 835 may be positioned on a circumferential portion of the parabolic main reflector 800 (as is shown in FIG. 8). These feed ports 835 are structured to allow a communicative coupling to occur between the embedded RF components (e.g., the waveguides) and one or more hardware components that are physically mounted to an outer portion of the outer face 815 (as shown in FIG. 6). By "communicatively coupled," it is meant that one or more transmission lines (e.g., wires, waveguides, or any other kind of transmission line currently known in the art) are able to pass through the feed ports 835.

Figure 9:
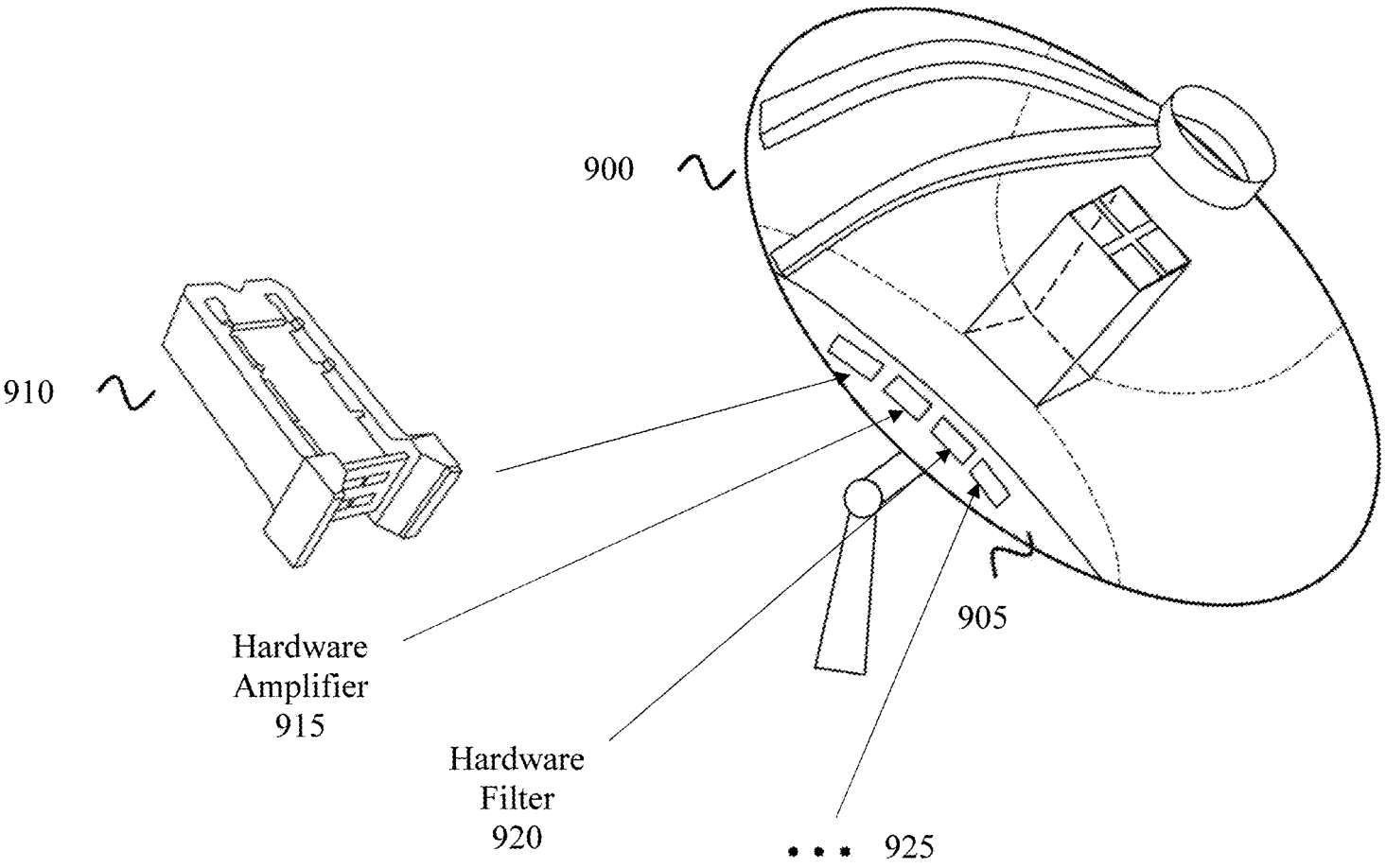
FIG. 9 illustrates a different view of the exemplary parabolic dish antenna with a portion of the antenna's internals revealed.

Accordingly, FIG. 8 illustrates an embodiment where a single-printed parabolic main reflector is fabricated so that it includes one or more RF components embedded therein. In contrast to FIG. 8, FIG. 9 illustrates an embodiment in which multiple different types of RF components are embedded within a parabolic main reflector. Accordingly, attention will now be directed to FIG. 9.

FIG. 9 shows a parabolic main reflector 900 with a cross cut 905. To clarify, a portion of the parabolic main reflector 900 has been cut off (i.e. as shown by the cross cut 905) to reveal some of the internals of the parabolic main reflector 900. In particular, this cross cut 905 shows that other types of RF components may also be embedded inside the parabolic main reflector 900.

By way of example and not limitation, a waveguide 910, a hardware amplifier component 915, and a hardware filter component 920 may be embedded inside the parabolic main reflector 900. Furthermore, the ellipses 925 demonstrate that other types of RF components may be embedded inside the parabolic main reflector 900 as well. One example of an additional RF component is a diplexer. Accordingly, the parabolic main reflector 900 may be fabricated using additive manufacturing techniques so that it includes one or more RF components embedded therein.

Figure 10:
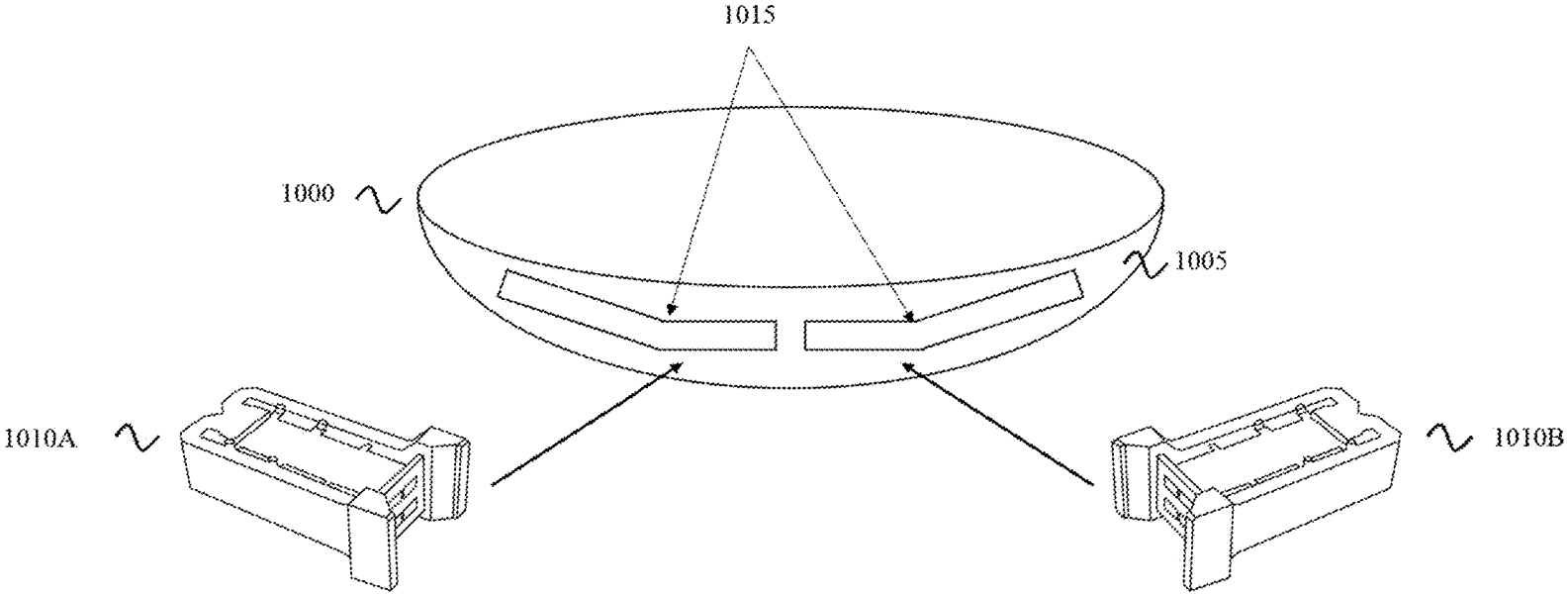
FIG. 10 illustrates yet another view of the exemplary parabolic dish antenna with a portion of the antenna's internals revealed.

Previously, it was mentioned that various optimizations may be performed on the RF components to ensure that those RF components operate properly when embedded inside of a main reflector. FIG. 10 shows an example of one type of optimization.

In particular, FIG. 10 shows a parabolic main reflector 1000 with a cross cut 1005. This cross cut 1005 is similar to the cross cut 905 in that it reveals a portion of the internals of the parabolic main array 1000.

Previously, the disclosure focused on embedding a monopulse comparator inside of a parabolic main reflector. As indicated earlier, a monopulse comparator is comprised of one or more waveguides. Accordingly, FIG. 10 shows a first waveguide 1010A and a second waveguide 1010B. The parabolic main reflector 1000 is fabricated in such a manner so that the two waveguides 1010A and 1010B are embedded between the inner and outer faces of the parabolic main reflector 1000 (resulting in four paths from the horn).

To improve the operability of these waveguides 1010A and 1010B, the waveguides 1010A and 1010B are fabricated so that they include one or more bends in their structures. For example, FIG. 10 shows bends 1015 in the structure of the waveguides 1010A and 1010B. Because of these bends 1015, the monopulse comparator, which includes the waveguides 1010A and 1010B, is fabricated so that it bends in a conformal manner to the parabolic geometry of the parabolic main reflector 1000. For instance, FIG. 10 shows that the bends 1015 cause the waveguides 1010A and 1010B is remain completely confined within the internal confines of the parabolic main reflector 1015. If the bends 1015 were not present, then portions of the waveguides 1010A and 1010B would protrude from the outer face of the parabolic main reflector 1000. Accordingly, the bends 1015 permit the waveguides 1010A and 1010B to remain completely within the inner portion of the parabolic main reflector 1000.

Additional optimizations are performed to determine where to place the bends 1015 on the waveguides 1010A and 1010B and to determine how much to angle the bends 1015. Notably, the placement and angle of the bends 1015 are selected so as to match impedances, which matching eliminates undesirable radio wave reflections. Accordingly, the placement and angle of the bends 1015 on the waveguides 1010A and 1010B are selected to eliminate reflected energy (i.e. to achieve the least amount of loss in the waveguides). Accordingly, the waveguides 1010A and 1010B are bent so as to generally follow the curve of the parabolic shape of the parabolic main reflector 1000. As indicated in FIG. 10, the bends 1015 include one or more discrete bends. By discrete, it is meant that a bend exists at a particular point on the waveguides 1010A and 1010B as opposed to the waveguides being bent in a continual arc-like manner. While the embodiment illustrated in FIG. 10 shows a waveguide with a single bend, other embodiments include additional bends in a single waveguide. Accordingly, some embodiments have waveguides with multiple discrete structural bends.

Figure 11:
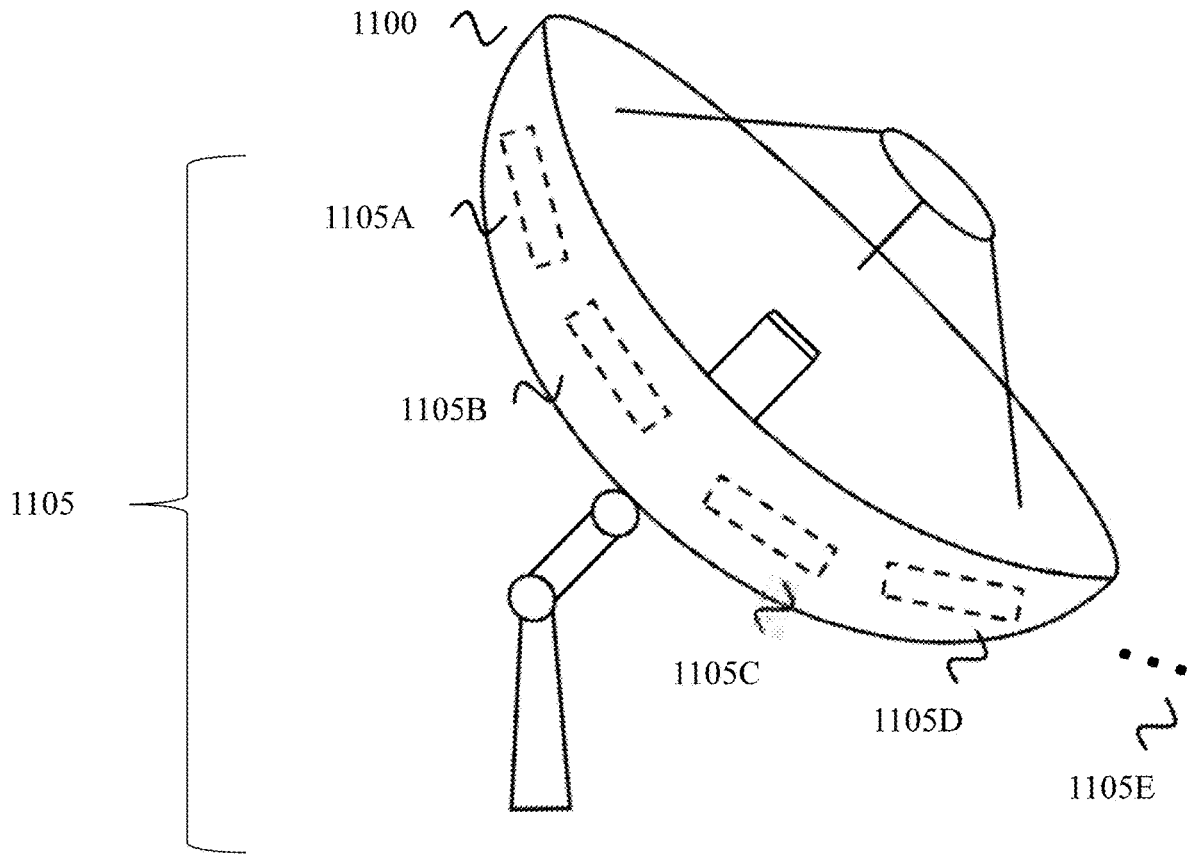
FIG. 11 shows another illustration of the exemplary parabolic dish antenna.

Having just described some of the specific characteristics of some of the embodiments, attention will now be directed to FIG. 11. Here, a parabolic dish 1100 is shown. This parabolic dish includes all of the other structural components that were discussed in connection with the exemplary dish antenna 100 of FIG. 1. As further illustrated in FIG. 11, however, the parabolic dish 1100 includes a plurality of embedded RF components 1105. These RF components 1105 are embedded between an inner face and an outer face of the parabolic dish 1100. Stated differently, the RF components 1105 are inside the parabolic dish 1100 such that they are not viewable via a cursory inspection of the parabolic dish 1100. The plurality of RF components 1105 include RF component 1105A, 1105B, 1105C, and 1105D. The ellipses 1105E demonstrates that any number of RF components may be embedded within the parabolic dish 1100. Accordingly, FIG. 11 illustrates only one example embodiment. Other embodiments might include fewer or more RF components in the parabolic dish 1100.

In some instances, the parabolic dish is part of a parabolic reflector antenna. This parabolic reflector antenna may comprise a feed horn array, one or more mounting struts, a sub-reflector, and the parabolic dish. This parabolic dish includes an inner face being formed in a parabolic shape. It also includes an outer face being formed in a different parabolic shape. Further, it may also include two monopulse comparator waveguides. Both of these waveguides are embedded in an inner body of the parabolic dish. This inner body is formed by a union of an outer circumference of the inner face and an outer circumference of the outer face. A second monopulse comparator waveguide may be disposed in the inner body at a position that is opposite to a position of the first monopulse comparator waveguide (as shown in FIG. 10).

In other instances, the parabolic dish might be a part of an antenna system. This antenna system may include one or more hardware processors (e.g., the hardware processors 305 of FIG. 3) and one or more computer-readable hardware storage devices (e.g., the storage 335 of FIG. 3). These hardware storage devices store computer-executable instructions that are executable by the one or more hardware processors. When executed, these instructions are configured to cause the antenna system to perform monopulse tracking according to known methodologies.

In some instances, the parabolic dish is a 9.5-inch antenna dish. Notably, however, the embodiments are not limited solely to a 9.5-inch dish.

In some instances, as discussed earlier, the inner body of the parabolic dish may include filtering hardware components (e.g., a diplexer) and amplifier hardware components.

As discussed in connection with FIG. 10, the parabolic dish may include a monopulse comparator waveguide that includes a first angle bend. This first angle bend is at an angle sufficient to cause the waveguide to be positioned between the inner reflective face (which has a parabolic shape) and the outer face (which has a different parabolic shape). In other words, the first angle bend causes the waveguide to have a non-planar geometric shape (i.e. it is bent).

By embedding some of the RF components inside the parabolic dish, the rear side of the parabolic dish is made available to place other hardware components. As a result, some embodiments include one or more RF hardware components that are physically mounted to an outer portion of the outer face of the parabolic dish (as is generally shown in FIG. 6). As a result, the parabolic dish may include one or more embedded monopulse comparator waveguides and one or more physically mounted outer portion hardware components (including RF components).

In embodiments that include two embedded monopulse comparator waveguides, the first monopulse comparator waveguide may be an azimuth comparator while the second may be an elevation comparator.

While the above discussion focused on the use of additive manufacturing techniques to create a single body dish antenna, other embodiments are also contemplated for embedding hardware components into a dish antenna. By way of example, an inner face of the dish antenna may be constructed. This inner face may have a thickness. Then, various hardware components may be physically mounted to a back side of the inner face. After those components are mounted, then an outer face may be constructed. This outer face may then be physically mounted to the back side of the inner face so as to cause the various hardware component to be enveloped between the inner face and the outer face. Then, additional hardware components may be physically mounted on a back portion of the outer face. As a result, instead of using additive manufacturing techniques, these embodiments are assembled in a piece-by-piece fashion to cause hardware components to be enveloped by the dish's inner and outer face. In these embodiments, additional back-end layers may continually be attached to the back end of the antenna to ensure that adequate space is available to mount all of the necessary hardware components.

Accordingly, having just described the structural aspects of a parabolic dish that has embedded RF components, attention will now be directed to FIG. 12. Specifically, FIG. 12 illustrates an exemplary method 1200 for fabricating a parabolic dish that has embedded RF components.

Initially, method 1200 includes an act (act 1210) in which a first portion of a dish antenna is fabricated using additive manufacturing techniques. This first portion is a part of an outer face of the dish antenna. By outer face, it is meant a rear side, or rather back side, of the dish antenna.

Then, method 1200 includes an act (act 1220) in which a monopulse comparator waveguide is fabricated immediately on top of the first portion. This monopulse comparator waveguide is also fabricated using additive manufacturing techniques. Further, the monopulse comparator waveguide is surrounded by a second portion of the outer face of the dish antenna. In other words, the outer face is continually built up around the monopulse comparator waveguide.

Finally, method 1200 includes an act (act 1230) in which an inner face of the dish antenna is fabricated on top of both the monopulse comparator waveguide and the second portion of the outer face of the dish antenna. As a result, the monopulse comparator waveguide is enveloped between the outer face and the inner face. In other words, the monopulse comparator waveguide is embedded inside of the dish antenna.

As a result, a dish antenna may be fabricated using additive manufacturing techniques. This dish antenna includes an embedded monopulse comparator (e.g., waveguides). The comparator is completely confined within the dish antenna. Furthermore, the comparator's waveguides include one or more bends to allow the waveguides to generally follow the dish antenna's parabolic shape.

Accordingly, the present embodiments provide significant advantages over the current technology by embedding RF components inside of a dish antenna.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A parabolic antenna reflector comprising:

an inner reflective face being formed in a parabolic shape, the inner reflective face including a first outer circumferential portion; and an outer face being formed in a different parabolic shape, the outer face including a second outer circumferential portion, wherein the first outer circumferential portion is coupled to the second outer circumferential portion to form an inner body between the inner reflective face and the outer face, and wherein the inner body comprises a first monopulse comparator waveguide such that the first monopulse comparator waveguide is embedded inside the inner body between the inner reflective face and the outer face.

2. The parabolic antenna reflector of claim 1, wherein the parabolic antenna reflector is a 9.5-inch antenna dish.

3. The parabolic antenna reflector of claim 1, wherein the inner body further comprises a filtering hardware component such that the filtering hardware component is also embedded between the inner reflective face and the outer face.

4. The parabolic antenna reflector of claim 1, wherein the inner body further comprises a second monopulse comparator waveguide, the first monopulse comparator waveguide and the second monopulse comparator waveguide forming a dual-axis monopulse comparator.

5. The parabolic antenna reflector of claim 1, wherein the inner body further comprises an amplifier hardware component such that the amplifier hardware component is also embedded between the inner reflective face and the outer face.

6. The parabolic antenna reflector of claim 1, wherein the inner body further comprises a filtering hardware component such that the filtering hardware component is also embedded between the inner reflective face and the outer face, and wherein the inner body further comprises a second monopulse comparator waveguide, the first monopulse comparator waveguide and the second monopulse comparator waveguide forming a dual-axis monopulse comparator.

7. The parabolic antenna reflector of claim 1, wherein the first monopulse comparator waveguide includes a first angle bend, the first angle bend being at an angle sufficient to cause the first monopulse comparator waveguide to be positioned between the inner reflective face having the parabolic shape and the outer face having the different parabolic shape, whereby the first angle bend causes the first monopulse comparator waveguide to have a non-planar geometric shape, and wherein the inner body further comprises a second monopulse comparator waveguide, the second monopulse comparator waveguide being confined within the inner body at a position that is opposite to a position of the first monopulse comparator waveguide.

8. The parabolic antenna reflector of claim 1, wherein the inner body further comprises a filtering hardware component such that the filtering hardware component is also embedded between the inner reflective face and the outer face, and wherein the first monopulse comparator waveguide includes a first angle bend, the first angle bend being at an angle sufficient to cause the first monopulse comparator waveguide to be positioned between the inner reflective face having the parabolic shape and the outer face having the different parabolic shape, whereby the first angle bend causes the first monopulse comparator waveguide to have a non-planar geometric shape.

9. The parabolic antenna reflector of claim 1, wherein the inner body further comprises a second monopulse comparator waveguide, the first monopulse comparator waveguide and the second monopulse comparator waveguide forming a dual-axis monopulse comparator, and wherein the inner body further comprises an amplifier hardware component such that the amplifier hardware component is also embedded between the inner reflective face and the outer face.

10. The parabolic antenna reflector of claim 1, wherein the parabolic antenna reflector is a 9.5-inch antenna dish and wherein the inner body further comprises a filtering hardware component such that the filtering hardware component is also embedded between the inner reflective face and the outer face.

11. A parabolic antenna reflector comprising:

an inner reflective face being formed in a parabolic shape, the inner reflective face including a first outer circumferential portion; and an outer face being formed in a different parabolic shape, the outer face including a second outer circumferential portion, wherein the first outer circumferential portion is coupled to the second outer circumferential portion to form an inner body between the inner reflective face and the outer face, wherein the inner body comprises a first monopulse comparator waveguide such that the first monopulse comparator waveguide is embedded inside the inner body between the inner reflective face and the outer face, and wherein the first monopulse comparator waveguide includes a first angle bend, the first angle bend being at an angle sufficient to cause the first monopulse comparator waveguide to be positioned between the inner reflective face having the parabolic shape and the outer face having the different parabolic shape, whereby the first angle bend causes the first monopulse comparator waveguide to have a non-planar geometric shape.

12. The parabolic antenna reflector of claim 11, wherein the parabolic antenna reflector is a 9.5-inch antenna dish.

13. The parabolic antenna reflector of claim 11, wherein the parabolic antenna reflector is a 9.5-inch antenna dish and wherein the inner body further comprises a filtering hardware component such that the filtering hardware component is also embedded between the inner reflective face and the outer face.

14. The parabolic antenna reflector of claim 11, wherein the inner body further comprises a second monopulse comparator waveguide, the first monopulse comparator waveguide and the second monopulse comparator waveguide forming a dual-axis monopulse comparator.

15. The parabolic antenna reflector of claim 11, wherein the inner body further comprises an amplifier hardware component such that the amplifier hardware component is also embedded between the inner reflective face and the outer face.

16. A parabolic antenna reflector comprising:

an inner reflective face being formed in a parabolic shape, the inner reflective face including a first outer circumferential portion; and an outer face being formed in a different parabolic shape, the outer face including a second outer circumferential portion, wherein the first outer circumferential portion is coupled to the second outer circumferential portion to form an inner body between the inner reflective face and the outer face, wherein the inner body comprises a first monopulse comparator waveguide such that the first monopulse comparator waveguide is embedded inside the inner body between the inner reflective face and the outer face, and wherein the inner body further comprises a second monopulse comparator waveguide, the second monopulse comparator waveguide being embedded within the inner body at a position that is opposite to a position of the first monopulse comparator waveguide.

17. The parabolic antenna reflector of claim 16, wherein the first monopulse comparator waveguide and the second monopulse comparator waveguide form a dual-axis monopulse comparator.

18. The parabolic antenna reflector of claim 16, wherein the inner body further comprises an amplifier hardware component such that the amplifier hardware component is also embedded between the inner reflective face and the outer face, and wherein the first monopulse comparator waveguide includes a first angle bend, the first angle bend being at an angle sufficient to cause the first monopulse comparator waveguide to be positioned between the inner reflective face having the parabolic shape and the outer face having the different parabolic shape, whereby the first angle bend causes the first monopulse comparator waveguide to have a non-planar geometric shape.

19. The parabolic antenna reflector of claim 16, wherein the parabolic antenna reflector is a 9.5-inch antenna dish and wherein the inner body further comprises a filtering hardware component such that the filtering hardware component is also embedded between the inner reflective face and the outer face.

20. The parabolic antenna reflector of claim 16, wherein the inner body further comprises a filtering hardware component such that the filtering hardware component is also embedded between the inner reflective face and the outer face, and wherein the first monopulse comparator waveguide includes a first angle bend, the first angle bend being at an angle sufficient to cause the first monopulse comparator waveguide to be positioned between the inner reflective face having the parabolic shape and the outer face having the different parabolic shape, whereby the first angle bend causes the first monopulse comparator waveguide to have a non-planar geometric shape.

* * * * *